US010334358B2

(12) United States Patent
Lau

(10) Patent No.: US 10,334,358 B2
(45) Date of Patent: Jun. 25, 2019

(54) CORRECTING FOR A LATENCY OF A SPEAKER

(71) Applicant: DTS, Inc., Calabasas, CA (US)

(72) Inventor: Dannie Lau, Los Angeles, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 15/617,673

(22) Filed: Jun. 8, 2017

(65) Prior Publication Data

US 2018/0359561 A1 Dec. 13, 2018

(51) Int. Cl.
*H04R 29/00* (2006.01)
*H04R 3/00* (2006.01)

(52) U.S. Cl.
CPC ..... *H04R 3/00* (2013.01); *H04R 2420/07* (2013.01); *H04R 2430/01* (2013.01)

(58) Field of Classification Search
CPC .... H04R 3/00; H04R 29/001; H04R 2430/01; H04R 2420/07
USPC ..... 381/56, 58, 59
See application file for complete search history.

(56) References Cited

U.S. PATENT DOCUMENTS 4,661,007 A 4/1987 Schneider
7,054,544 B1 5/2006 Tanaka
7,555,354 B2 6/2009 Walsh et al.
8,995,240 B1 3/2015 Erven et al.
9,219,460 B2 12/2015 Bush
9,329,831 B1 5/2016 Fullerton et al.
9,330,096 B1 5/2016 Fullerton et al.
9,331,799 B2 5/2016 Gao et al.
9,363,601 B2 6/2016 Ramos
9,367,283 B2 6/2016 Kuper
2014/0177864 A1* 6/2014 Kidron ..... H04N 21/4307 381/80
2015/0078596 A1* 3/2015 Sprogis ..... H04R 5/027 381/303
2016/0011850 A1* 1/2016 Sheen ..... H04S 7/301 715/709

(Continued)

OTHER PUBLICATIONS

"International Application Serial No. PCT/US2018/036680, International Search Report dated Jul. 9, 2018", 3 pgs.

(Continued)

*Primary Examiner* — Xu Mei
*Assistant Examiner* — Ammar T Hamid
(74) *Attorney, Agent, or Firm* — Schwegman Lundberg & Woessner, P.A.

(57) ABSTRACT

A user device can be used to correct for a latency of a speaker. The user device can communicate an indication to the speaker to play a sound at a first time. The user device can record a second time at which a microphone on the user device detects the sound. The first and second times can be synchronized to a clock of a computer network. The user device can compare the first and second times to determine a latency of the speaker. The user device can communicate adjustment data corresponding to the determined latency to the speaker. The speaker can use the adjustment data to correct for the determined latency. In some examples, the user device can display instructions to position the user device a specified distance from the speaker, and can account for a time-of-flight of sound to propagate along the specified distance.

17 Claims, 3 Drawing Sheets

(56) References Cited

U.S. PATENT DOCUMENTS

| | | | | |
|---|---|---|---|---|
| 2016/0080887 | A1* | 3/2016 | Tikkanen | H04S 7/40 381/303 |
| 2016/0255302 | A1* | 9/2016 | Greene | H04N 21/4307 381/74 |
| 2017/0346588 | A1* | 11/2017 | Prins | H04J 3/0667 |

OTHER PUBLICATIONS

"International Application Serial No. PCT/US2018/036680, Written Opinion dated Jul. 9, 2018", 6 pgs.

* cited by examiner

CORRECTING FOR A LATENCY OF A SPEAKER

FIELD OF THE DISCLOSURE

The present disclosure relates to correcting for a latency of a speaker.

BACKGROUND OF THE DISCLOSURE

A speaker can include a processor that converts a digital input to the speaker into an analog current that drives an air-vibrating element or elements in the speaker. The sound produced by the speaker can lag behind the digital input by a particular time known as a latency. Unfortunately, such a latency is not standard from speaker to speaker, or from speaker manufacturer to speaker manufacturer, or from speakers to video displays. Such non-standard latencies can desynchronize the speakers in a multi-speaker system, or can desynchronize an audio signal from a corresponding video signal.

SUMMARY

One example includes a method for correcting for a latency of a speaker. A user device can communicate an indication to the speaker to play a sound at a first time. In some examples, the first time can be synchronized to a clock of a computer network. The user device can record a second time at which a microphone on the user device detects the sound. In some examples, the second time can be synchronized to the clock of the computer network. The user device can compare the first and second times to determine a latency of the speaker. The user device can communicate adjustment data corresponding to the determined latency to the speaker. The adjustment data can be used by the speaker to correct for the determined latency.

Another example includes a system, which can include a microphone; a processor; and a memory device storing instructions executable by the processor. The instructions can be executable by the processor to perform steps for correcting for a latency of a speaker. The steps can include communicating an indication to the speaker to play a sound at a first time, the first time being synchronized to a clock of a computer network; recording a second time at which the microphone detects the sound, the second time being synchronized to the clock of the computer network; comparing the first and second times to determine a latency of the speaker; and communicating adjustment data corresponding to the determined latency to the speaker. The adjustment data can be used by the speaker to correct for the determined latency.

Another example includes a method for correcting for a latency of a speaker. A user interface on a smart phone can display instructions to position the smart phone a specified distance from the speaker. The smart phone can communicate an indication to the speaker to play a sound at a first time. The first time can be being synchronized to a clock of a computer network. The smart phone can timestamp a second time at which a microphone on the smart phone detects the sound. The second time can be synchronized to the clock of the computer network. The smart phone can subtract a time stamp corresponding to the second time from a time stamp corresponding to the first time, and account for a time-of-flight of sound to propagate along the specified distance, to determine a latency of the speaker. The smart phone can communicate adjustment data corresponding to the determined latency to the speaker. The adjustment data can be used by the speaker to correct for the determined latency.

BRIEF DESCRIPTION OF THE DRAWINGS

Corresponding reference characters indicate corresponding parts throughout the several views. Elements in the drawings are not necessarily drawn to scale. The configurations shown in the drawings are merely examples, and should not be construed as limiting the scope of the invention in any manner.

DETAILED DESCRIPTION

Figure 1:
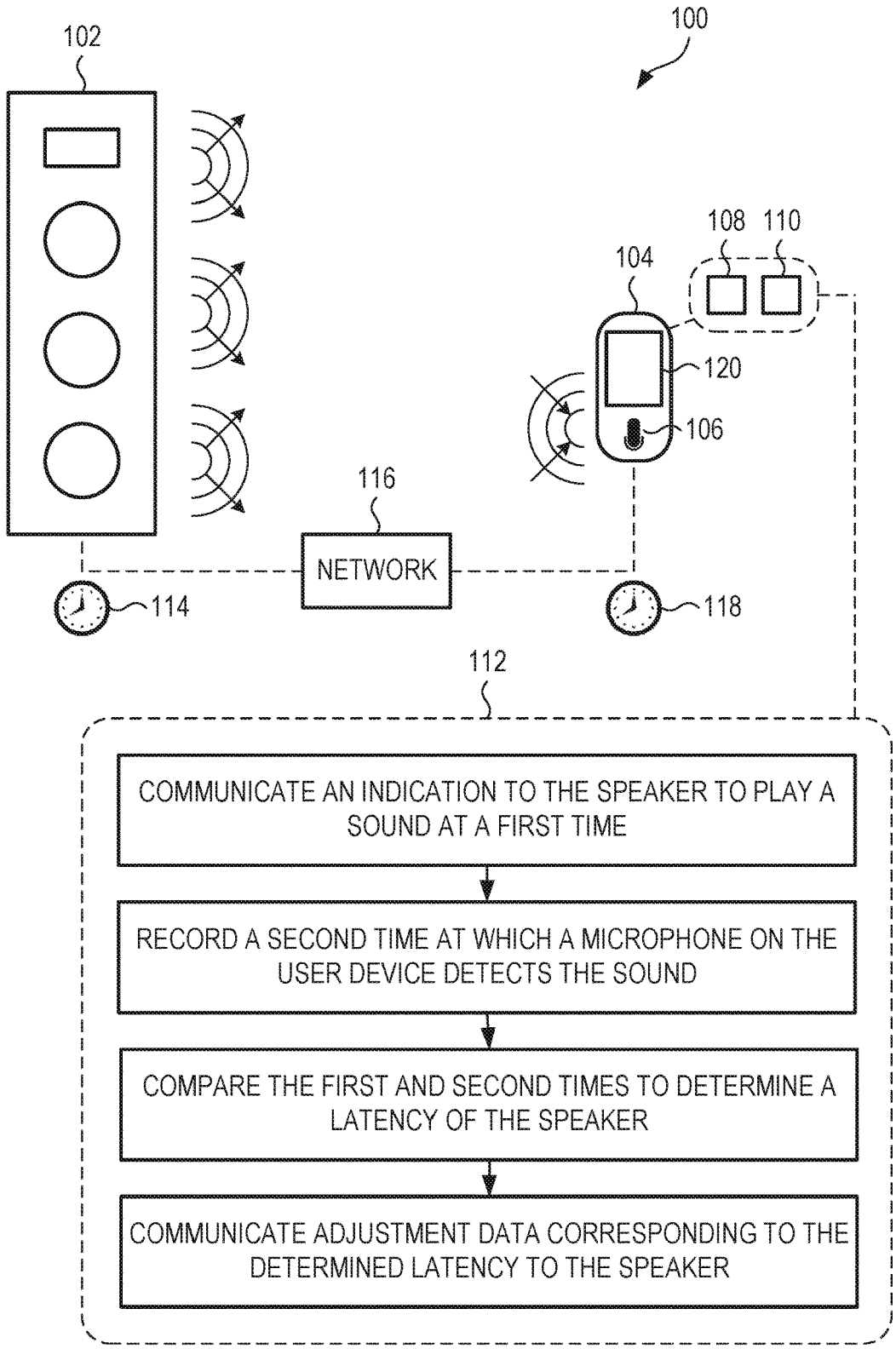
FIG. 1 shows a block diagram of a system that can correct for a latency of a speaker, in accordance with some examples.

FIG. 1 shows a block diagram of a system 100 that can correct for a latency of a speaker 102, in accordance with some examples. In some examples, the speaker 102 can be one of a set top box, a television, or a soundbar. In some examples, the speaker 102 can be controlled by a High-Definition Multimedia Interface. In this example, the speaker 102 is not part of the system 100, but is in communication with the system 100 through a wired or wireless network. The system 100 can adjust, correct, or control the latency of the speaker 102, typically to match the latency of one or more additional audio or video components. The system 100 of FIG. 1 is but one example of a system 100 that can control a latency of a speaker 102; other suitable systems can also be used.

The system 100 for controlling speaker latency can run as an application on a user device 104. In the example of FIG. 1, the user device 104 is a smart phone. Alternatively, the user device 104 can be a tablet, laptop, computer, or any suitable device that includes a microphone 106 or can be attached to a microphone 106. It will be understood that any of these alternative user devices can be used in place of the smart phone of FIG. 1.

The user device 104 can include a processor 108 and a memory device 110 for storing instructions 112 executable by the processor 108. The processor 108 can execute the instructions 112 to perform steps to correct for a latency of the speaker 102. The steps can include communicating an indication to the speaker 102 to play a sound at a first time 114, the first time 114 being synchronized to a clock of a computer network 116; recording a second time 118 at which the microphone 106 detects the sound, the second time 118 being synchronized to the clock of the computer network 116; comparing the first and second times to determine a latency of the speaker 102; and communicating adjustment data corresponding to the determined latency to the speaker 102, the adjustment data used by the speaker 102 to correct for the determined latency.

The user device 104 can include a user interface 120 having a display. In some examples, the user device 104 can display instructions to position the user device 104 a specified distance from the speaker 102. The user device 104 can further account for a time-of-flight of sound to propagate along the specified distance. Time-of-flight refers to the amount of time a sound takes to propagate in air from the speaker 102 to the microphone 106.

These steps and others are discussed in detail below with regard to FIG. 2.

Figure 2:
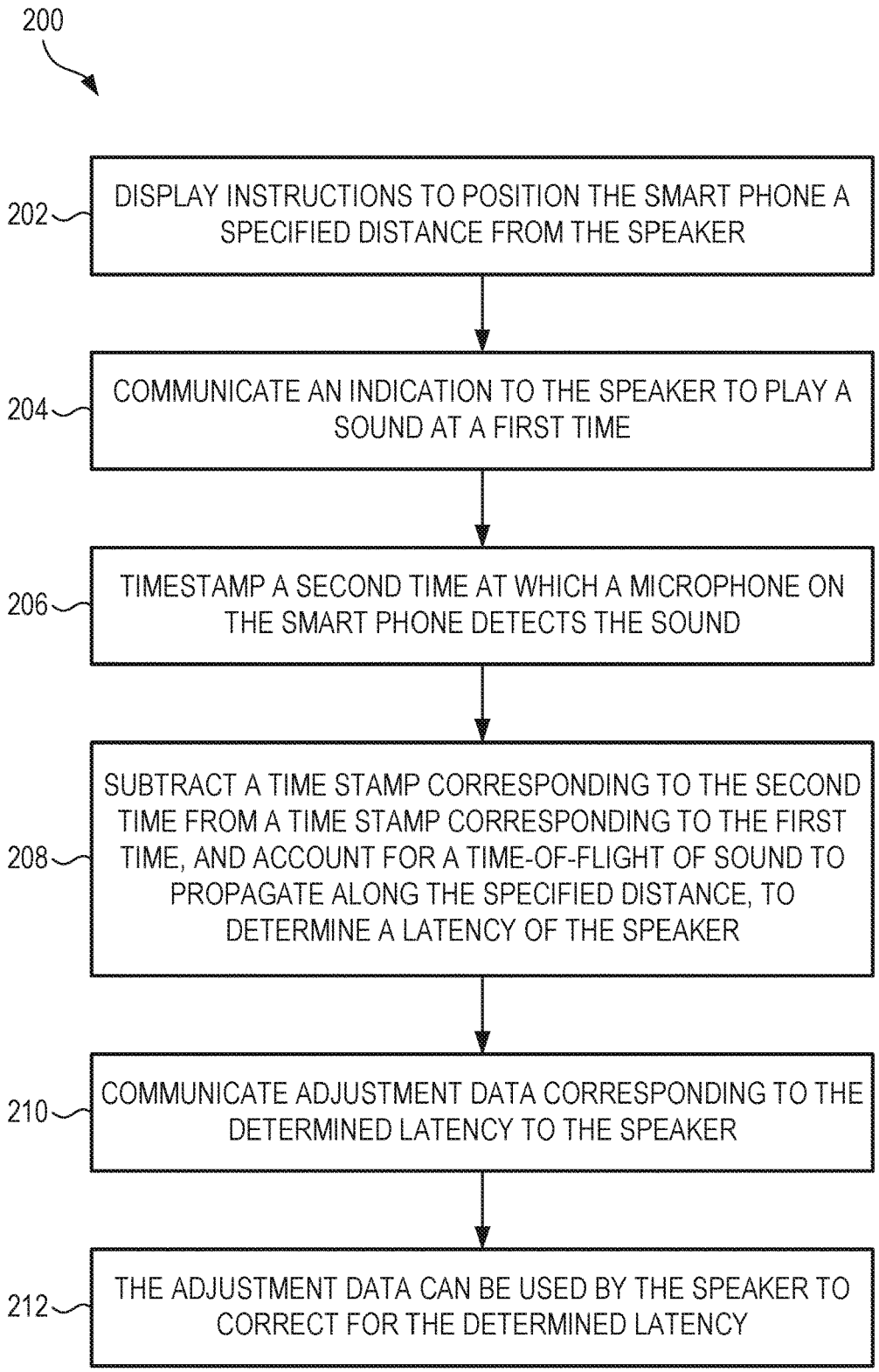
FIG. 2 shows a flowchart of an example of a method for correcting for a latency of a speaker, in accordance with some examples.

FIG. 2 shows a flowchart of an example of a method 200 for correcting for a latency of a speaker, in accordance with some examples. The method 200 can also adjust or control a latency of the speaker, and can optionally set the latency of the speaker to match the latency of one or more additional audio or visual components. In some examples, the method 200 can be executed by a software application stored locally on a user device. In the specific example that follows, the method 200 is executed by a smart phone, but it will be understood that the method 200 can alternatively be executed by a tablet, a laptop, a computer, a computing device, or another suitable user device.

At operation 202, the smart phone can display, on a user interface on the smart phone, instructions to position the smart phone a specified distance from the speaker. For instance, the display on the smart phone can present instructions to position the smart phone one meter away from the speaker, and can present a button to be pressed by the user when the smart phone is suitably positioned. Other user interface features can also be used.

At operation 204, the smart phone can communicate an indication to the speaker to play a sound at a first time. For example, the indication can include instructions to play the sound at a specified first time in the future. In some examples the first time can be synchronized to a clock of a computer network. In some examples, the first time can be synchronized to an absolute time standard determined by the computer network. For example, the first time can be synchronized to the absolute time standard via a Precision Time Protocol, or by another suitable protocol. In other examples, the first time can be synchronized to a relative time standard communicated via the computer network. For example, the relative time standard can be determined by the smart phone, the speaker, or another element not controlled directly by the computer network.

At operation 206, the smart phone can timestamp a second time at which a microphone on the smart phone detects the sound. In some examples, the second time can be synchronized to the clock of the computer network, optionally in the same manner as the first time. In some examples, the second time can be synchronized to an absolute time standard determined by the computer network, such as via a Precision Time Protocol. In other examples, the second time can be synchronized to a relative time standard communicated via the computer network. In other examples, the first and second times can be synchronized to one another without using a network-based time, such as by using a Network Time Protocol or another suitable technique.

At operation 208, the smart phone can subtract a time stamp corresponding to the second time from a time stamp corresponding to the first time, to determine a latency of the speaker. In some examples, the smart phone can additionally account for a time-of-flight of sound to propagate along the specified distance, to determine the latency of the speaker. For example, if the smart phone is positioned one meter from the speaker, the time-of-flight can be expressed as the quantity, one meter, divided by the speed of sound in air, approximately 344 meters per second, to give a time-of-flight of about 2.9 milliseconds.

At operation 210, the smart phone can communicate adjustment data corresponding to the determined latency to the speaker. The speaker can use the adjustment data to correct for the determined latency. By adjusting or controlling the latency of the speaker, the latency of the speaker can optionally be set to match the latency of one or more additional audio or visual components.

Figure 3:
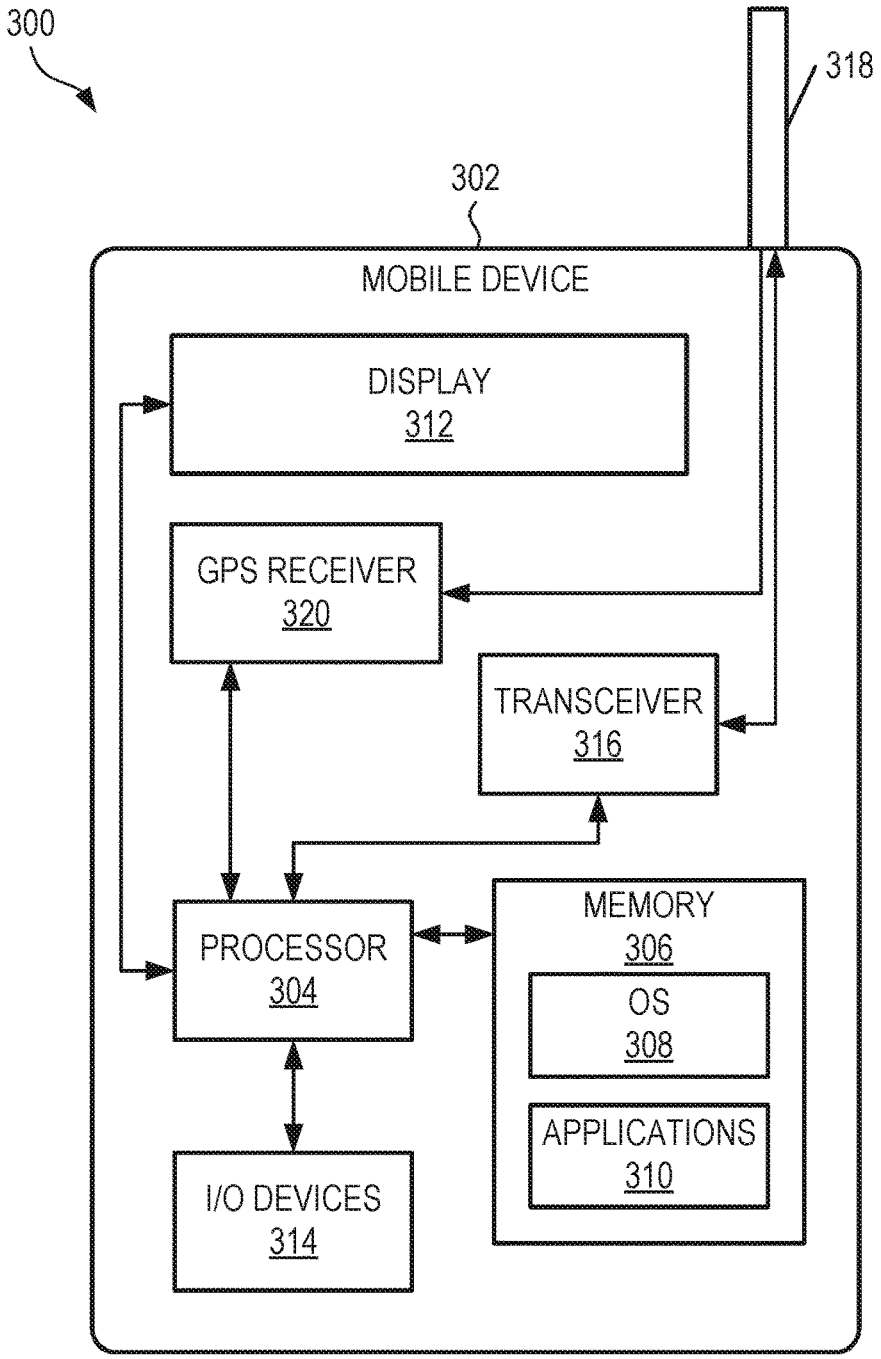
FIG. 3 is a block diagram showing an example of a latency-adjustment system that can be used to correct for a latency of a speaker, in accordance with some examples.

FIG. 3 is a block diagram showing an example of a latency-adjustment system 300 that can be used to correct for a latency of a speaker, in accordance with some examples.

In some examples, the latency-adjustment system 300 can be configured as software executable on a user device, such as a smart phone, a tablet, a laptop, a computer, or another suitable device. In the specific example of FIG. 3, the latency-adjustment system 300 includes a software application that can run on a mobile device 302, such as a smart phone.

The latency-adjustment system 300 can include a processor 304, and a memory device 306 storing instructions executable by the processor 304. The instructions can be executed by the processor 304 to perform a method for correcting for a latency of a speaker.

The mobile device 302 can include a processor 304. The processor 304 may be any of a variety of different types of commercially available processors 304 suitable for mobile devices 302 (for example, an XScale architecture microprocessor, a microprocessor without interlocked pipeline stages (MIPS) architecture processor, or another type of processor 304). A memory 306, such as a random access memory (RAM), a flash memory, or other type of memory, is typically accessible to the processor 304. The memory 306 may be adapted to store an operating system (OS) 308, as well as application programs 310, such as a mobile location enabled application. In some examples, the memory 306 can be used to store the lookup table discussed above. The processor 304 may be coupled, either directly or via appropriate intermediary hardware, to a display 312 and to one or more input/output (I/O) devices 314, such as a keypad, a touch panel sensor, a microphone, and the like. In some examples, the display 312 can be a touch display that presents the user interface to a user. The touch display can also receive suitable input from the user. Similarly, in some examples, the processor 304 may be coupled to a transceiver 316 that interfaces with an antenna 318. The transceiver 316 may be configured to both transmit and receive cellular network signals, wireless data signals, or other types of signals via the antenna 318, depending on the nature of the mobile device 302. Further, in some configurations, a GPS receiver 320 may also make use of the antenna 318 to receive GPS signals. In some examples, the transceiver 316 can transmit signals over a wireless network that correspond to logical volume levels for respective speakers in a multi-speaker system.

The techniques discussed above are applicable to a speaker, but can also be applied to other sound-producing devices, such as a set-top box, an audio receiver, a video receiver, an audio/video receiver, or a headphone jack of a device.

While this invention has been described as having example designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for correcting for a latency of a speaker, the method comprising:

displaying, on a user interface on a user device, instructions to position the user device a specified distance from the speaker;

with the user device, communicating an indication to the speaker to play a sound at a first time;

with the user device, recording a second time at which a microphone on the user device detects the sound;

with the user device, comparing the first and second times and accounting for a time-of-flight of sound to propagate along the specified distance to determine a latency of the speaker; and with the user device, communicating adjustment data corresponding to the determined latency to the speaker, the adjustment data used by the speaker to correct for the determined latency.

2. The method of claim 1, wherein the first and second times are synchronized to a clock of a computer network.

3. The method of claim 2, wherein recording the second time at which the microphone on the user device detects the sound comprises:

time stamping a signal produced by the microphone on the user device.

4. The method of claim 3, wherein comparing the first and second times to determine the latency of the speaker comprises:

subtracting a time stamp of the signal produced by the microphone on the user device from a time stamp corresponding to the first time.

5. The method of claim 2, wherein the speaker is one of a set top box, a television, or a soundbar.

6. The method of claim 2, wherein the speaker is controlled by a High-Definition Multimedia Interface.

7. The method of claim 2, wherein the user device is a smart phone.

8. The method of claim 2, wherein the first time and the second time are synchronized to an absolute time standard determined by the computer network.

9. The method of claim 8, wherein the first time and the second time are synchronized to the absolute time standard via a Precision Time Protocol.

10. The method of claim 2 wherein the first time and the second time are synchronized to a relative time standard communicated via the computer network.

11. The method of claim 2, further comprising:

with the user device, communicating adjustment data to the speaker used by the speaker to correct for the determined latency.

12. A system, comprising:

a microphone;

a processor; and a memory device for storing instructions executable by the processor, the instructions being executable by the processor to perform steps for correcting for a latency of a speaker, the steps comprising:

displaying, on a user interface on a smart phone that includes the microphone, instructions to position the smart phone a specified distance from the speaker;

communicating an indication to the speaker to play a sound at a first time, the first time being synchronized to a clock of a computer network;

recording a second time at which the microphone detects the sound, the second time being synchronized to the clock of the computer network;

comparing the first and second times and accounting for a time-of-flight of sound to propagate along the specified distance to determine a latency of the speaker; and communicating adjustment data corresponding to the determined latency to the speaker, the adjustment data used by the speaker to correct for the determined latency.

13. A method for correcting for a latency of a speaker, the method comprising:

displaying, on a user interface on a smart phone, instructions to position the smart phone a specified distance from the speaker;

with the smart phone, communicating an indication to the speaker to play a sound at a first time, the first time being synchronized to a clock of a computer network;

with the smart phone, timestamping a second time at which a microphone on the smart phone detects the sound, the second time being synchronized to the clock of the computer network;

subtracting a time stamp corresponding to the second time from a time stamp corresponding to the first time, and accounting for a time-of-flight of sound to propagate along the specified distance, to determine a latency of the speaker; and with the smart phone, communicating adjustment data corresponding to the determined latency to the speaker, the adjustment data used by the speaker to correct for the determined latency.

14. The method of claim 13, wherein the speaker is controlled by a High-Definition Multimedia Interface.

15. The method of claim 13, wherein the first time and the second time are synchronized to an absolute time standard determined by the computer network.

16. The method of claim 15, wherein the first time and the second time are synchronized to the absolute time standard via a Precision Time Protocol.

17. The method of claim 13, wherein the first time and the second time are synchronized to a relative time standard communicated via the computer network.

* * * * *